US005092228A

United States Patent [19]

Pfeiffer, Jr. et al.

[11] Patent Number: 5,092,228

[45] Date of Patent: Mar. 3, 1992

[54] EXHAUST DISTRIBUTION SYSTEM

[76] Inventors: Edward A. Pfeiffer, Jr., 1011 Howard Rd., Warminster, Pa. 18974; Paul Hamilton, 78 Jolly La., Levittown, Pa. 19055

[21] Appl. No.: 608,412

[22] Filed: Nov. 2, 1990

[51] Int. Cl.[5] ..... B05B 15/00

[52] U.S. Cl. ..... 454/63; 104/52

[58] Field of Search ..... 98/49, 116, 115.4; 104/52; 110/159

[56] References Cited

U.S. PATENT DOCUMENTS

| | | | |
|---|---|---|---|
| 929,115 | 7/1909 | Schlacks | 98/49 X |
| 1,337,347 | 4/1920 | Devine | 104/52 |
| 1,820,355 | 8/1931 | Kelly | 104/52 |
| 1,866,626 | 7/1932 | Day et al. | 104/52 |
| 2,206,263 | 7/1940 | Planit | 104/52 |
| 3,941,041 | 3/1976 | Sprout | 48/115.4 |
| 4,233,889 | 11/1980 | Nederman | 98/115.4 |
| 4,312,645 | 1/1982 | Mavros et al. | 55/213 |
| 4,335,574 | 6/1982 | Sato et al. | 60/311 |
| 4,389,923 | 6/1983 | Ludscheidt | 98/115.4 |
| 4,567,817 | 2/1986 | Fleischer et al. | 98/49 |
| 4,762,054 | 8/1988 | Melville et al. | 98/115.4 |

FOREIGN PATENT DOCUMENTS 284964 9/1914 Fed. Rep. of Germany ..... 104/52

*Primary Examiner*—Harold Joyce

*Attorney, Agent, or Firm*—Caesar, Rivise, Bernstein, Cohen & Pokotilow, Ltd.

[57] ABSTRACT

An exhaust distribution system for a building to automatically attach/detach to a vertical exhaust stack of a vehicle located within the building. The system includes an elongate track for guiding movement of a trolley therealong from a first position adjacent the entrance of the building to a second remote position at which the vehicle is to be parked. The trolley supports one end, e.g., a mouth, of a flexible hose and includes a guiding device to orient the hose's mouth with respect to the exhaust stack to receive the exhaust fumes therefrom. An assembly automatically biases the trolley to the first position on the track. The system also includes a blower, a pressure responsive sensor, and a solenoid controlled damper to automatically vent the exhaust fumes out of the building whenever the pressure in the hose exceeds a predetermined level, e.g., a pressure level which would exist if the vehicle's motor was running.

25 Claims, 4 Drawing Sheets

EXHAUST DISTRIBUTION SYSTEM

BACKGROUND OF THE INVENTION

Operating gasoline or diesel-powered vehicles, such as trailer trucks, fire trucks and other emergency response vehicles, in a building, as is typically the case with such vehicles, results in the engine exhaust fumes to be trapped within the building, with potentially serious consequences to personnel located therein. For example, since emergency vehicles, such as fire trucks, are often operated for some time in a bays within a building which is often in close proximity to offices, eating areas, dressing rooms and sleeping quarters, individuals may come in direct contact with exhaust fumes and/or the oily, sooty residue produced by diesel engines and deposited on the surroundings, if they are not properly trapped and vented out of the building. Over time, fumes can build up in undesirable areas and studies show that prolonged breathing of diesel and other exhaust fumes presents major health risks.

Fire stations and the emission of exhaust fumes in and around such areas are regulated by the National Fire Protection Association. This Association requires that fire stations utilize an exhaust distribution system to remove and vent the fumes from the fire station.

The prior art is replete with vehicle exhaust distribution systems suitable for automobiles, fire trucks and other vehicles, however these systems suffer from one or more drawbacks.

In particular, U.S. Pat. No. 4,233,889 (Nederman) discloses an exhaust system which utilizes a track forming a gas throughflow duct. The track is arranged for guiding a movable gas passage unit therealong so that the two communicate. Exhaust fumes from a vehicle are carried via a flexible hose to a unit disposed on the track. The fumes are carried through the unit into the track and out of the building.

U.S. Pat. No. 4,762,054 (Melville et al.) discloses a system similar to the previously described Nederman patent an utilizes a track to carry the fumes therealong.

U.S. Pat. No. 4,567,817 (Fleischer et al.) discloses an exhaust-gas offtake track for exhausting fumes from a track-guided vehicle. The exhaust stack of the vehicle extends vertically into a collecting funnel. The funnel forms a portion of a trolley assembly to slide down the track and communicates with the interior thereof to carry fumes from the vehicle into the interior of the track for venting out of the building.

Other devices which vent and/or trap exhaust fumes are disclosed in U.S. Pat. Nos. 4,389,923 (Ludscheidt), 4,312,645 (Mavros et al.) and U.S. Pat. No. 4,335,574 (Sato et al.).

It is believed that Nederman Inc. of Westland, Michigan offers an exhaust venting device under the trade designation Nederman Vertical Stack System. The applicant is not fully cognizant of the construction of that system but believes that it is arranged for use with vehicles having a vertically extending exhaust pipe (stack) and includes a hollow track to which a flexible hose is connected at one end. A trolley box or housing is believed to be mounted on the track for longitudinal movement therealong. The trolley box includes a pair of angled arms to form a V-shaped mouth into which the top end of a vertical exhaust stack is guided when the fire truck is backed into its parking spot. Apparently, the trolley then moves along the track carrying fumes from the stack through the trolley and into the horizontally disposed longitudinal track. The fumes then pass into the flexible conduit at the end of the track and out of the building. It is believed that the trolley box has a spring loaded gate which releases the vehicle exhaust stack when the vehicle departs from the building.

While the foregoing prior art system may achieve their intended purpose, namely, venting the exhaust fumes from the vehicle out of the building, they nevertheless leave much to be desired from various standpoints. For example, such prior art systems are quite complicated and expensive to install, e.g., they require a special track to carry fumes therealong. Moreover, and perhaps more importantly, many such systems appear to require manual connection and/or disconnection from the vehicle. This factor is undesirable since it increases the possibility that the system may be forgotten to be utilized when a vehicle is located within the building.

Accordingly, a need exists for a exhaust distribution system to be used in a garage o bay to trap and safely vent exhaust fumes.

OBJECTS OF THE INVENTION

It therefore is a general object of this invention to provide an exhaust distribution system which overcomes the disadvantages of the prior art.

It is also an object of this invention to provide an exhaust distribution system which does not require manual connection or disconnection to the vehicle or manual activation of the system.

It is another object of this invention to provide an exhaust distribution system for automatically connecting to a vertical stack of a vehicle when the vehicle is within a structure in which it may be operated.

It is another object of this invention to provide an exhaust distribution system which automatically vents exhaust fumes out of a building in which it is located when the motor of the vehicle is operating.

It is another object of this invention to provide an exhaust distribution system which is simple in construction.

It is a further object of this invention to provide a exhaust distribution system which is inexpensive to install and operate, and requires minimal maintenance.

It is still a further object of the invention to provide a system which minimizes interference of the system with the surroundings and individuals therein.

SUMMARY OF THE INVENTION

These and other objects of this invention are achieved by providing an exhaust fumes distribution system for use within a structure, e.g., a fire house, adjacent a space in which a vehicle, e.g., a fire truck, having a vertically oriented, open ended, exhaust stack is to be located. The system is arranged to automatically attach/detach to the open end of the vehicle's stack to discharge any exhaust fumes out of the structure. The system comprises track means, trolley means, flexible hose means, biasing means, pressure sensing means, and venting means.

The track means comprises an elongated member mounted above the space in which the vehicle is to be located and supports the trolley means for slidable movement therealong from a first position adjacent an entrance to the structure to a second position within the structure remote from the entrance. The hose means is coupled to the venting means and the trolley means.

The biasing means is arranged for automatically positioning the trolley means at the first position on the track.

The trolley means includes first means for receiving the open end of the vertical exhaust stack when the vehicle is moved into the structure from the first position toward the second position.

The pressure sensing means is arranged to sense a predetermined pressure of exhaust fumes from the stack for causing the venting means to operate, whereupon the exhaust fumes pass into the hose means, through the venting means and out of the structure.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENT

Figure 1:
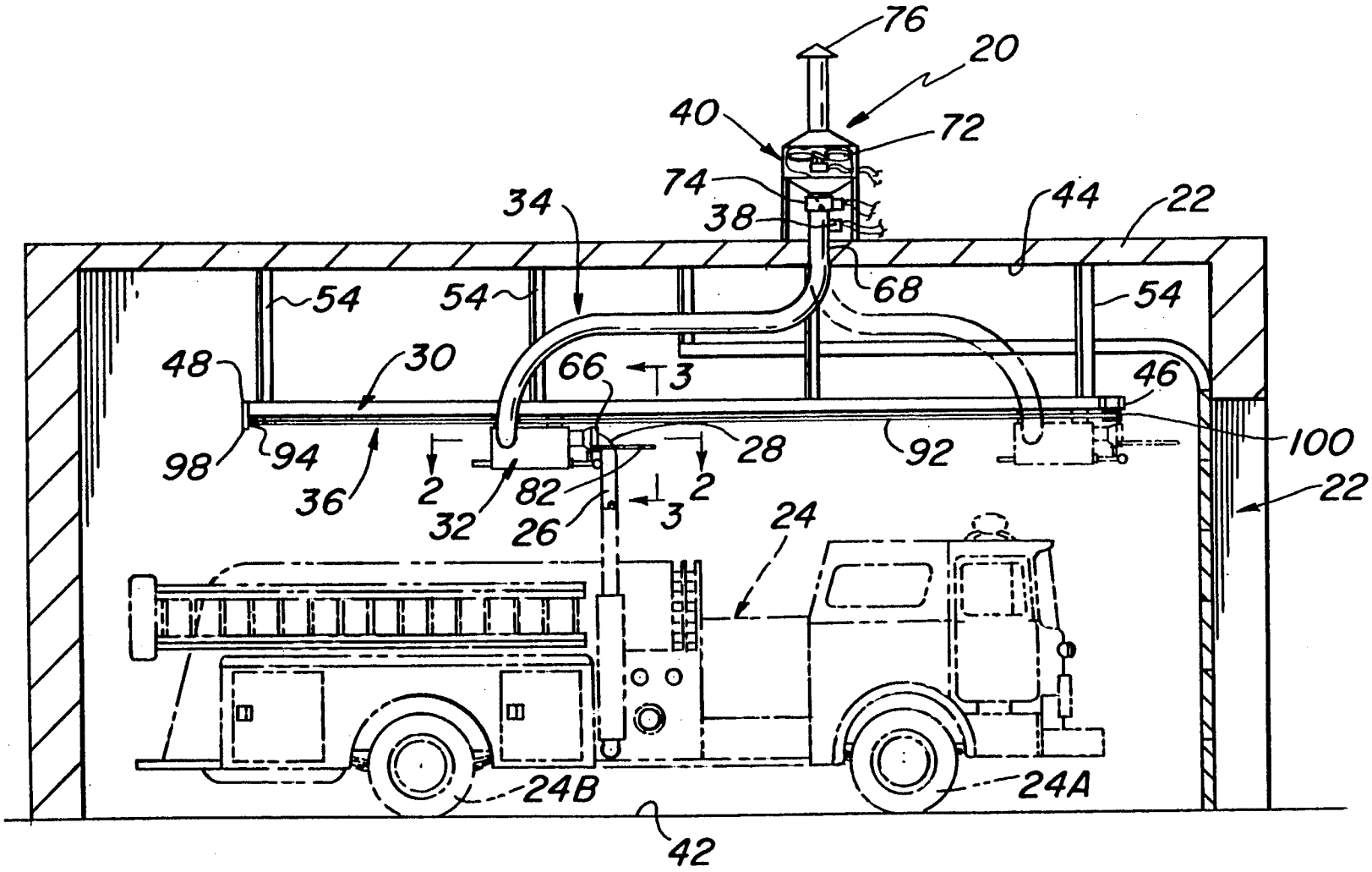
FIG. 1 is a side elevation view, partially in section, showing the system of the present invention mounted within a building for venting exhaust fumes from a vehicle located therein.

Referring now to various figures of the drawings where like reference numerals refer to like parts, there is shown at 20 in FIG. 1, an exhaust distribution system constructed in accordance with this invention.

The details of the system 20 will be described later. Suffice for now to state that the exhaust distribution system 20 is arranged to be mounted within a building 22 or any other structure in which a vehicle having a petroleum, e.g., gasoline or diesel, burning engine is to be located and operated. The system is so arranged to automatically cooperate with the vehicle's exhaust stack to vent any exhaust fumes produced by that vehicle. In particular, the system includes means to automatically couple itself to the vehicle's exhaust system stack whenever the vehicle is moved into the building to a first position adjacent the building's entrance or door 22A and to remain coupled thereto when the vehicle is moved further back into the building to its normal parking location or bay and to remain coupled thereto when the vehicle is moved from the bay out of the structure. Moreover, the system includes means which automatically senses when the vehicle's engine is running to cause the system to operate to vent the vehicles exhaust fumes out of the building to the ambient surroundings.

In the embodiment of the invention shown herein, the vehicle is a conventional fire truck (shown in phantom in FIG. 1) and has a vertically disposed exhaust stack 26. The upper end of the stack curves to a horizontal orientation and terminates in an open end 28. The specific vehicle 24 is merely exemplary of any type of vehicle having a vertically oriented exhaust stack for which the subject invention has utility. Moreover, it is to be understood that the subject invention can be used in any type of structure to vent exhaust fumes from any such vertical stacked vehicle disposed therein.

Figure 4:
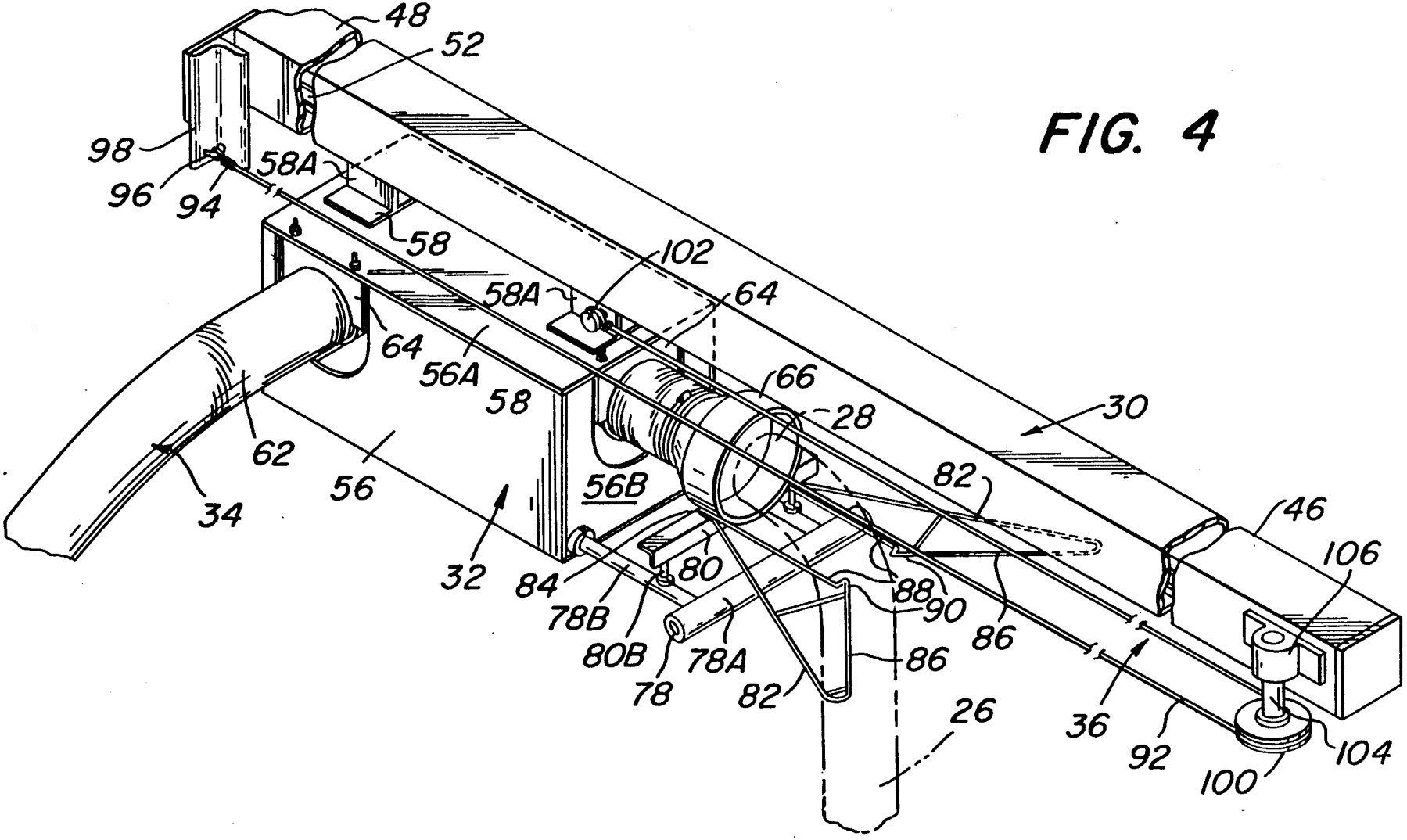
FIG. 4 is an enlarged isometric view, partially in section, of a portion of the system shown in FIG. 1.

As can be seen in FIGS. 1 and 4, the system 20 basically comprises a track assembly 30, a trolley assembly 32, a flexible hose assembly 34, a biasing assembly 36, a pressure sensing subsystem 38, and a venting assembly 40.

The system 20 is mounted in the building so that its track assembly 30 extends along the space or bay 42 in which the vehicle 24 is to be parked in order to automatically couple itself to the exhaust stack when the vehicle is moved into the building to the bay. To that end, the track assembly 30 basically comprises an elongated linear track extending horizontally below the roof or ceiling 44 of the building and immediately to the side of the bay 42 from a point closely adjacent the entrance 22A of the building to a point further into the building, e.g., adjacent the building's rear wall as shown in FIG. 1. When the track 24 is within the bay 42 its front wheels 24A and rear wheels 24B are at the positions shown in FIG. 3.

The mounting of the track assembly 30 via the use of supports (to be described later) from the ceiling minimizes potential interference with the system 20 during use or when the vehicle 24 is absent and the garage 22 is used for other purposes.

The length of the track assembly 30 is dependent on the vehicle, the garage length, the distance from the entrance to the garage to the bay at which the vehicle is to be parked, etc. Accordingly, the length of the track assembly can be selected as desired for the application.

The track is preferably formed of a square tubing 50 of any suitable material, e.g., steel, and has a channel or slot 52 (FIG. 3) extending the length of the tubing in the bottom wall thereof. The tubing is supported in position via plural, conventional hangers or supports 54.

The trolley assembly 32 basically comprises a box-like housing having an upper wall 56A on which a pair of mounting brackets 58 are fixedly secured. Each bracket includes a vertically oriented web portion which extends through the track's channel 52. Each web also includes an opposed pair of rollers 60 mounted thereon for rolling along the bottom wall of the track on either side of the channel. Accordingly, the trolley assembly is supported for rolling movement along the track between the ends thereof. The forward end of the track is denoted by the reference numeral 46 while the rear end of the track is denoted by the reference numeral 48.

It should be pointed out that the preferred embodiment of this invention, the rollers 60 are arranged to roll within the tubing 50 forming the track in order to prevent their contamination by soot or other debris. However, it should be readily apparent to those skilled in the art that any other suitable form of track/rollers may be utilized to effect the movement of the trolley and the hose assembly supported thereby along the path the vehicle is to be moved when it enters the building and leaves the building.

Figure 5:
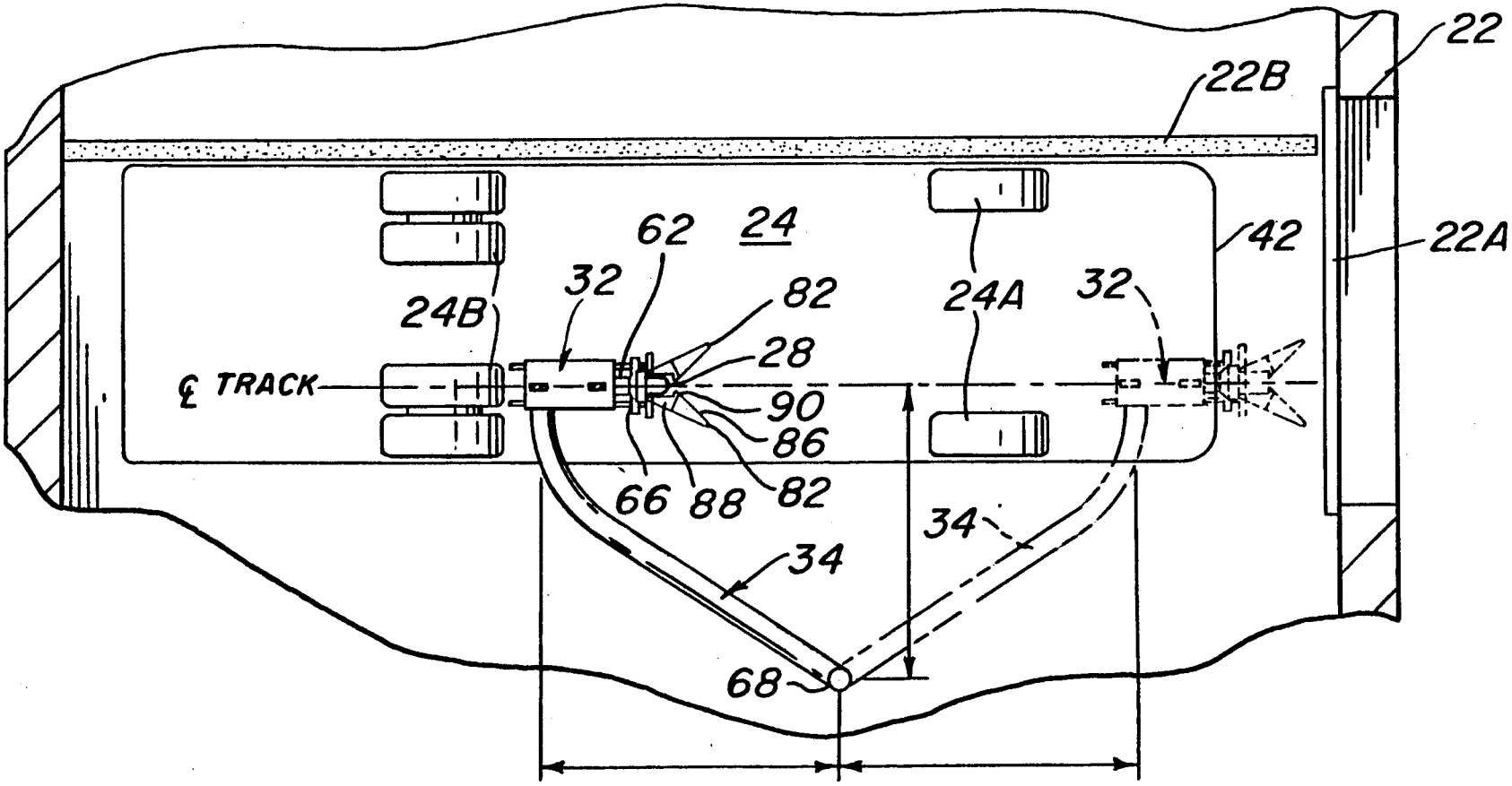
FIG. 5 is a top plan view, partially in section, of the building shown in FIG. 1 with the system of this invention disposed therein.

When the trolley is located at the forward end 46 of the track, as shown by the phantom lines in FIG. 1, it is said to be in its ready position since it is ready to be engaged by the open end of the vehicle's exhaust stack when the vehicle is backed into the building. To expedite the alignment of the vehicle to the track, a line or stripe 22B (FIG. 5) is painted on the building's floor laterally of the bay 42, i.e., to the side of the track to act as a guide for the driver to follow in moving the vehicle to and from the bay.

As will be described later, once the truck's stack engages the trolley assembly at the ready position, the further backward movement of the truck along line 22B into the bay 42 carries the trolley along the track to a retracted position (shown by the solid lines in FIG. 1) toward the rear of the building when the truck is parked in its bay 42.

The system 20 includes means to automatically bias the trolley assembly toward the end 46 of the track to the ready position. Thus, as the truck is moved out of the building from its parked position, the trolley follows the truck to effect the venting of the exhaust fumes therefrom until the truck departs the structure, i.e., its stack passes beyond the end of the track. The means for effecting this automatic positioning of the trolley constitutes the heretofore identified biasing means 36.

Figure 2:
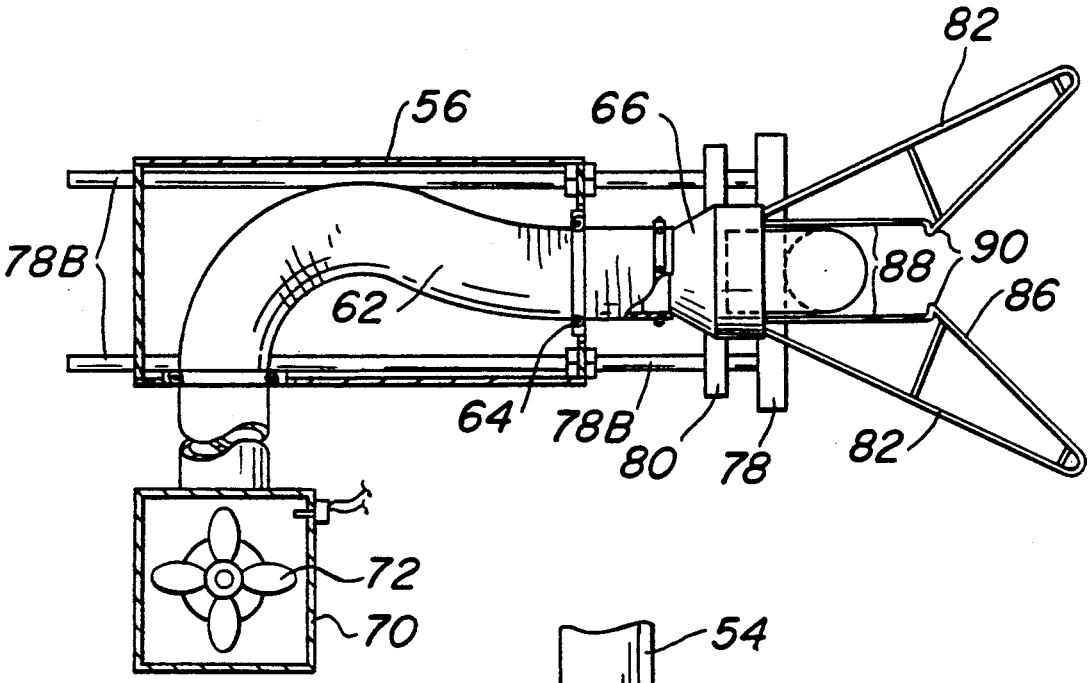
FIG. 2 is an enlarged sectional view taken along lines 2—2 of FIG. 1.
Figure 3:
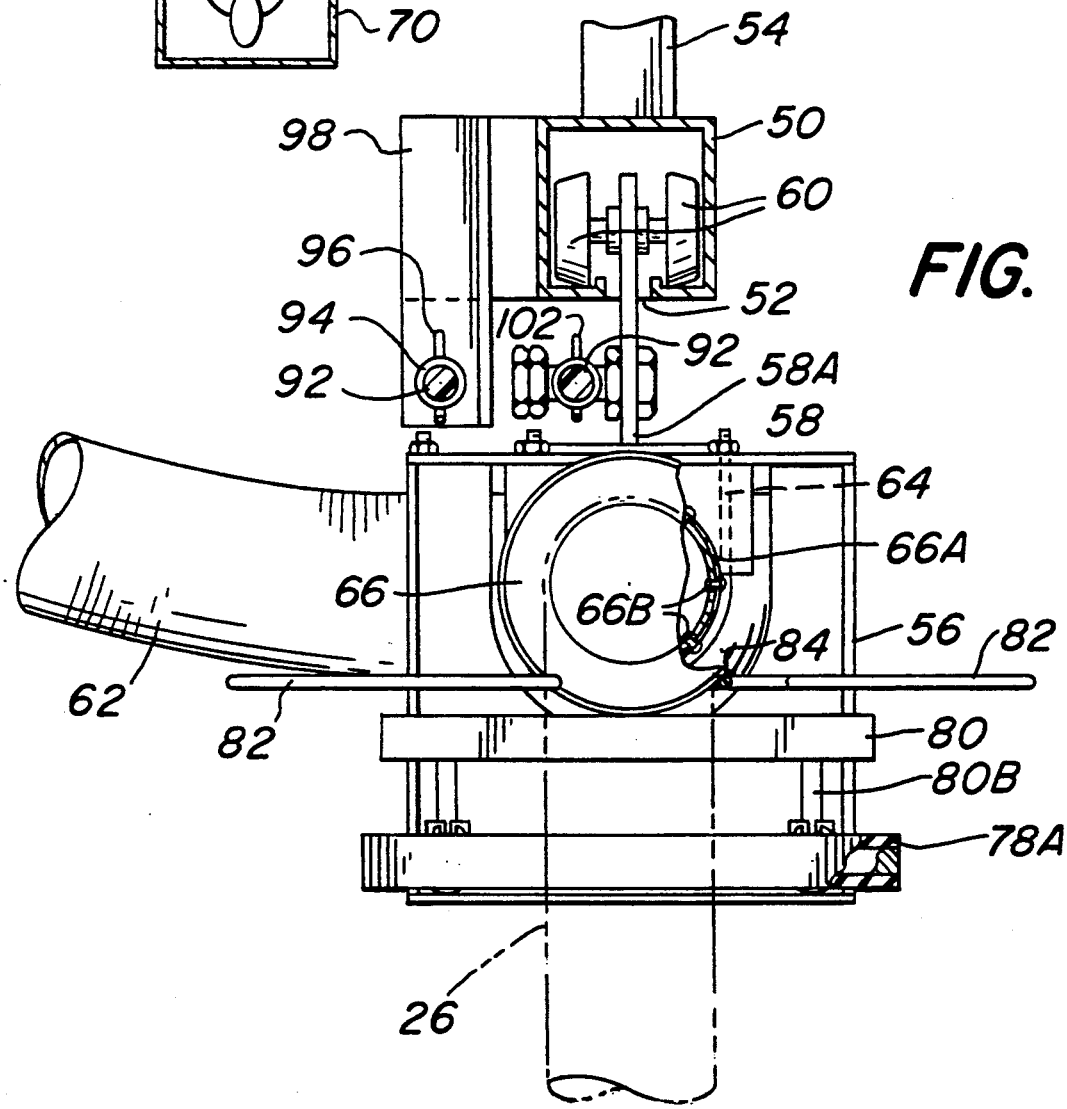
FIG. 3 is an enlarged sectional view taken along line 3—3 of FIG. 1.

The fumes from the exhaust stack are carried from the stack via the hose assembly, a portion of which is coupled to the trolley assembly, as will now be described. Thus, as can be seen in FIGS. 1-3, the hose assembly 34 basically comprises an elongated flexible tube or hose 62 formed of any suitable material, e.g., plastic, rubber, etc., and may be either smooth walled or corrugated. One end portion of the hose extends through and is mounted on the trolley body 56 via respective conventional hose clamps 64. The free end of the hose 62 terminates in a flared-mouth, formed of a funnel-shaped member 66. The member 66 serves to receive the open-end 28 of the exhaust stack 26 when the vehicle is brought into the building to the ready position 46, as will be described later.

In the preferred embodiment of this invention the mouth 66 of the hose assembly is made up of a heat resistant material, e.g., light weight metal, such as aluminum, to prevent the hot exhaust stack 26 from damaging the exhaust hose 62, such as could occur if the stack were to contact the exhaust hose and the exhaust were formed of a material susceptible to heat induced damage. The funnel-shape of the mouth expedites the alignment of the mouth with the end 28 of the exhaust stack, as will be discussed later. The member 66 is fixedly secured on the free end of the hose 62 via a band 66A and plural rivets 66B (FIG. 3).

As can be seen in FIG. 1 the other end of the hose 62 extends through an opening 68 in the roof o ceiling of the building 22 to communicate with the venting means 40 located thereat. The venting assembly 40, while shown mounted on the roof, can be mounted through a wall or on a wall, depending upon the application. Moreover, the hose assembly 34 need not extend through an opening 68 in either the roof or a wall of the structure, but instead may terminate at any fixed duct-work within the building, so long as that duct-work is in communication with a vent assembly 40 constructed in accordance with this invention mounted at any suitable location.

If the system 20 is arranged like that shown in FIG. 1 It is preferable that the venting assembly 40 be located at approximately the half-way point between the maximum excursion of the trolley assembly, that is, the ready position shown by the phantom line in FIG. 1 and the retracted position shown by the solid lines therein.

The venting means basically comprises a housing 70 mounted on the roof (or ceiling) and in which is located an electrically operated exhaust fan 72, the heretofore identified pressure-sensing subsystem 38 and a solenoid-operated damper assembly 74. The venting means housing also includes an outlet or chimney 76 at the top end thereof and through which the exhaust fumes gain egress to the ambient atmosphere.

The pressure-sensing subsystem basically comprises a conventional pressure responsive, electrically operated switch mounted in the tube 62 and which is arranged to sense the existence of a predetermined pressure therein. The switch provides an electrical signal via associated conductors to means (not shown) associated with the exhaust fan 72 whenever the pressure sensed exceeds a predetermined threshold. This causes the fan to be energized, that is, start rotating. The switch is set to provide that electrical signal at a pressure level within the hose which is predetermined and which is reached when exhaust fumes pass into the hose (as occurs when the vehicle's engine is running). The switch is also arranged to disable the fan, that is, turn it off, whenever the pressure drops below that threshold, e.g., when the vehicle's engine is off.

The solenoid operated damper assembly 74 is also mounted within the hose 62 and is normally closed to isolate the interior of the hose (and hence the interior of the building) from the ambient surroundings. This feature insures that heat from the building does not escape through the hose while also preventing pressure blowback from the ambient atmosphere outside the building from falsely activating the system, that is, causing the pressure sensor to initiate operation of the fan. Moreover, the damper normally being closed helps create a rapid pressure increase so that pressure sensor causes the fan to turn on whenever the vehicle's engine is running, even at low speeds, such as occurs at idle.

In order to prevent damage to the trolley, such as could occur if the exhaust stack were to contact it, when the truck 24 is brought into the building, the trolley assembly 32 includes an adjustable bumper 78 mounted thereon. The bumper includes a transversely extending cross-member 78A which is mounted on a pair of support rods 78B. The cross-member 78A includes a resilient or shock absorbent covering thereon as shown in FIG. 3 to prevent damage to the vehicle's stack when it contacts the bar 78A The support rods 78B project through the housing 56 and outward from the front wall 56B thereof. Thus, as will be appreciated by those skilled in the art, when the vehicle 24 is backed into the garage 22 to the position so that the open end 28 of the stack 26 is immediately adjacent the end 46 of the track, the stack portion contiguous with open end 28 will engage the bumper bar 78A. This action will prevent any damage to the trolley assembly or to the supported hose assembly.

In order to support the hose assembly as the appropriate height for receipt of the open end 28 of the stack within the funnel shaped mouth 66 of the hose, the trolley assembly also includes a support bar 80 mounted thereon. The support bar 80 is an L-shaped elongated member which is mounted on the pair of support rods 78B and extends therebetween parallel to the bumper 78. The bar 80 is located at an elevated position with respect to the bumper 78A via the use of a pair of mounting rods 80B projecting upward from respective ones of the support rods 78B.

The support bar 80 is arranged to support directly thereon the outer surface of the funnel-shaped mouth 66. Accordingly, the support bar 80 is mounted on the bumper assembly 78 so that its top surface is at the exact height of the open end 28 of the fire truck's exhaust stack 26.

In accordance with the preferred embodiment of this invention the position of exhaust stack bumper can be adjusted via means (not shown), depending upon the length and/or curvature of the open end 28 of the exhaust stack so that that opening will be received centrally within the mouth of the hose assembly. The height of the support bar 80 can also be adjusted to insure that the open end 28 of the stack is received within the open mouth 66 of the hose assembly.

The mouth 66 of the hose assembly rests freely on the top of the support bar 80 so that it may move from side-to-side with respect thereto. By so doing the mouth is automatically positioned accurately with respect to the open end of the stack when the truck is moved into the bay 42 (as will be described later). Moreover, the side-to-side movement of the hose mouth 66 may be accentuated by extending the length of the flexible exhaust hose 62 which projects beyond the front wall 56B of the trolley and by also extending the length of the support bar 80.

In order to facilitate the alignment of the open end 28 of the exhaust stack within the mouth 66, the mouth 66 also includes guide means 82 mounted thereon. The guide means 82 basically comprises a pair of triangular shaped, wire members. Each of the members is fixedly secured, e.g., welded, to the outer periphery of the funnel-shaped mouth 66 at point 84 (FIG. 3). The two members 82 project outward from the mouth 66 to define between them a generally V-shaped channel portion 86 leading into a linear channel position 88. The linear channel portion terminates at the opening of the hose mouth 66.

The V-shaped channel 86 and the communicating linear shaped channel 88 serve to receive portions of the stack 26 adjacent the open end 28 when the vehicle is brought into the building. In particular the V-shaped portion of the channel 86 first receives the upper end of the stack, even if the stack is not axially aligned with the mouth 66 of the hose assembly when the vehicle is moved into the bay 42. The continued movement of the vehicle further into the bay causes the engaged stack portion to slide along the portions of the member 82 toward the entrance to the linear extending channel portion 88. This action has the effect of automatically orienting the mouth 66 with respect to the open end 28 of the stack 26. Further movement of the vehicle into the bay causes the stack to move into the channel portion 88, whereupon the outlet opening 28 of the stack enters the mouth 66 of the hose assembly. Moreover, since the funnel-shaped mouth 66 of the hose assembly may slide from side-to-side across support bar 80, the exhaust stack 26 may be laterally offset from the centerline of the trolley housing ye still its open end 28 ma be received within the mouth 66.

Inasmuch as the members 82 will be engaged by the hot exhaust stack, those members are preferably formed of heat resistant material, e.g., metal.

As can be seen clearly in FIG. 4, the point at which the V-shaped channel 86 merges with the linear shaped channel 88 defined by the two members 82 includes a pair of inwardly directed projections 90. These inwardly directed projections serve to trap the upper portion of the stack within the channel 88, for reasons to be described later.

In order for the system 20 to maximize the removal of exhaust fumes as the vehicle enters/exists the garage, it is preferable that the trolley and supported hose assembly follow the vehicle as the vehicle moves along the length of the track from the ready position to the retracted position wherein the vehicle is parked within its bay 42, and to thereafter follow the vehicle back along the track to the ready position adjacent the track end 46 when the vehicle exits the building. In accordance with the preferred aspect of this invention, the movement of the trolley assembly from end 46 down the track toward end 48 is effected by the movement of the vehicle itself into the building against the bias provided by the biasing assembly 36 (to be described hereinafter). The movement of the trolley down the track towards the end 46 is effected by the bias assembly 36.

The bias assembly 36 may be of any suitable construction. In the preferred embodiment herein that assembly basically comprises a conventional bungee cord formed of any strong, yet resilient material, and having one end 94 fixedly secured via a hook 96 to a bracket 98 fixedly mounted on the end 48 of the track 50. The other end of the bungee cord extends about a horizontally mounted pulley 100 and terminates at a fixed connection 102 to a pin mounted on the bracket 58 disposed closest to the front end 56B of the trolley assembly. The pulley 100 is mounted on a shaft 104 mounted within a journal 106 on the track 50 at its end 46.

With the bungee cord connected as just described it will be understood by those skilled in the art that the normal contraction of the cord 9 will tend to pull the trolley down the track so that it is located at end 46, i.e., is at the ready position. This action insures that the trolley is located at the ready position when the vehicle 24 is out of the building. When the vehicle is backed into the building, such that the upper end of its stack engages the trolley assembly, as described earlier, the continued movement of the vehicle 24 back into the building moves the trolley down the track, thereby stretching the bungee cord 92 about the pulley. Thus, the entire time that the vehicle is within the building its stack will be received within the hose assembly so that any vehicle exhaust produced will be vented as described earlier.

The heretofore described projections 90 of the guide members 82 serve to trap the stack within the channel portion 88 so that the stack outlet 28 is located within the tubing mouth 66 as the vehicle moves out of the building.

Once the trolley has reached the front end 46 of the track, the continued movement of the vehicle out of the building causes the two members 82 to spring apart slightly, whereupon the stack clears the inward projections 90 and the vehicle can then freely depart the building, leaving the trolley at the ready position.

Without further elaboration the foregoing will so fully illustrate our invention that others may, by applying current or future knowledge, adopt the same for use under various conditions of service.

I claim:

1. An exhaust fumes distribution system for use within a structure adjacent a space in which a vehicle having a vertically oriented, open ended, exhaust stack is to be located to automatically attach/detach to the open end of said stack to discharge exhaust fumes from said vehicle out of said structure, said system comprising track means, trolley means, flexible hose means, biasing means, pressure sensing means, and venting means, said track means comprising an elongated member mounted above said space and supporting said trolley mean for slidable movement therealong from a first position adjacent an entrance to said structure to a second position within said structure remote from said entrance, said vending means being in communication with the outside of said structure, said hose means being coupled to said venting means and said trolley means, said biasing means being arranged for automatically positioning said trolley means at said first position, said trolley means including first means for receiving said open end of the vertical exhaust stack when said vehicle is moved into said structure from said first position to said second position, said pressure sensing means being arranged to sense a predetermined pressure of exhaust fumes from said stack for causing said venting means to operate, whereupon said exhaust fumes pass into said hose means, through said venting means and out of said structure.

2. The system of claim 1 wherein said pressure sensing means causes said venting means to cease operation when said pressure is below said predetermined pressure.

3. The system of claim 1 wherein said venting means comprises an electrical blower, which when operated draws said fumes from said stack through said hose and out of said structure.

4. The system of claim 2 wherein said venting means comprises an electrical blower, which when operated draws said fumes from said stack through said hose and out of said structure.

5. The system of claim 1 wherein said hose means comprises a first open mouth supported by said first means of said trolley means, said trolley means additionally comprising, guiding means adjacent said mouth for orienting said mouth with respect to said vertical exhaust stack so that said open end is located immediately adjacent said mouth.

6. The system of claim 5 wherein said trolley means additionally comprises bumper means precluding said stack from engaging said hose means.

7. The system of claim 5 wherein said guiding means comprises a pair of extending members mounted on said mouth and forming a channel therebetween into which said open end of said stack is guided when said vehicle is moved to said first position.

8. The system of claim 7 wherein said channel is generally V-shaped.

9. The system of claim 7 wherein said guiding means comprises a pair of projections for capturing said stack within said channel.

10. The system of claim 9 wherein said channel is generally V-shaped.

11. The system of claim 2 wherein said hose means comprises a first open mouth supported by said first means of said trolley means, said trolley means additionally comprising, guiding means adjacent said mouth for orienting said mouth with respect to said vertical exhaust stack so that said open end is located immediately adjacent said mouth

12. The system of claim 11 wherein said trolley means additionally comprises bumper means precluding said stack from engaging said hose means.

13. The system of claim 11 wherein said guiding means comprises a pair of extending members mounted on said mouth and forming a channel therebetween into which said open end of said stack is guided when said vehicle is moved to said first position.

14. The system of claim 13 wherein said channel is generally V-shaped.

15. The system of claim 13 wherein said guiding means comprises a pair of projections for capturing said stack within said channel.

16. The system of claim 15 wherein said channel is generally V-shaped.

17. The system of claim 5 wherein the mouth is funnel-shaped.

18. The system of claim 11 wherein the mouth is funnel-shaped.

19. The system of claim 1 wherein said biasing means comprises a pulley and a resilient elastic cord, one portion of said cord being connected to the trolley means, another portion of said cord being fixedly connected with respect to track means, and another portion of said cord extending about said pulley, whereupon said cord biases said trolley means to move along the track to said first position, said biasing means being overcome by the movement of said vehicle from said first position to said second position.

20. The system of claim 5 wherein said biasing means comprises a pulley and a resilient elastic cord, one portion of said cord being connected to the trolley means, another portion of said cord being fixedly connected with respect to track means, and another portion of said cord extending about said pulley, whereupon said cord biases said trolley means to move along the track to said first position, said biasing means being overcome by the movement of said vehicle from said first position to said second position.

21. The system of claim 11 wherein said biasing means comprises a pulley and a resilient elastic cord, one portion of said cord being connected to the trolley means, another portion of said cord being fixedly connected with respect to track means, and another portion of said cord extending about said pulley, whereupon said cord biases said trolley means to move along the track to said first position, said biasing means being overcome by the movement of said vehicle from said first position to said second position.

22. The system of claim 13 wherein said biasing means comprises a pulley and a resilient elastic cord, one portion of said cord being connected to the trolley means, another portion of said cord being fixedly connected with respect to track means, and another portion of said cord extending about said pulley, whereupon said cord biases said trolley means to move along the track to said first position, said biasing means being overcome by the movement of said vehicle from said first position to said second position.

23. The system of claim 2 wherein said venting means additionally comprises a solenoid operated damper to normally isolate the interior of said hose means from the outside of said structure.

24. The system of claim 3 wherein said venting means additionally comprises a solenoid operated damper to normally isolate the interior of said hose means from the outside of said structure.

25. The system of claim I wherein said venting means is locate approximately midway along the length of said track means.

* * * * *